US011739578B2

(12) United States Patent
Invernizzi et al.

(10) Patent No.: US 11,739,578 B2
(45) Date of Patent: Aug. 29, 2023

(54) FURNISHING ELEMENT HINGE AND FURNISHING ELEMENT

(71) Applicant: MOLTENI & C. S.P.A., Giussano (IT)

(72) Inventors: Stefano Invernizzi, Giussano (IT); Tiziano Frigerio, Giussano (IT)

(73) Assignee: MOLTENI & C. S.P.A., Giussano (IT)

( * ) Notice: Subject to any disclaimer, the term of this patent is extended or adjusted under 35 U.S.C. 154(b) by 0 days.

(21) Appl. No.: 17/624,866

(22) PCT Filed: Jul. 13, 2020

(86) PCT No.: PCT/IB2020/056560
§ 371 (c)(1),
(2) Date: Jan. 5, 2022

(87) PCT Pub. No.: WO2021/019337
PCT Pub. Date: Feb. 4, 2021

(65) Prior Publication Data

US 2022/0170302 A1 Jun. 2, 2022

(30) Foreign Application Priority Data

Aug. 1, 2019 (IT) ..... 102019000013620

(51) Int. Cl.
*E05D 7/00* (2006.01)

(52) U.S. Cl.
CPC .... *E05D 7/0054* (2013.01); *E05D 2007/0063* (2013.01); *E05Y 2900/20* (2013.01)

(58) Field of Classification Search
CPC ..... E05D 7/0054; E05D 2007/0063; E05Y 2900/20
See application file for complete search history.

(56) References Cited

U.S. PATENT DOCUMENTS 9,790,722 B2 * 10/2017 Sun ..... E05D 7/0027
2006/0168760 A1 * 8/2006 Espindola ..... E05D 7/02 16/374

(Continued)

FOREIGN PATENT DOCUMENTS

CH 331159 A 7/1958
CN 106593161 A 4/2017

(Continued)

OTHER PUBLICATIONS

International Search Report for International Patent Application No. PCT/IB2020/056560, dated Jan. 20, 2021.

(Continued)

*Primary Examiner* — James O Hansen
(74) *Attorney, Agent, or Firm* — CANTOR COLBURN LLP

(57) ABSTRACT

A furnishing element hinge movably connecting a door to a fixed structure of a furnishing element is provided. The fixed structure rests on a support surface and delimits a compartment. The furnishing element hinge has a fixed hinge part connected to the fixed structure and a movable hinge part connected to the door. The movable hinge part is movable at least rotatably with respect to the fixed hinge part at least between a first position, adapted to open the compartment, and a second position, adapted to close the compartment. The furnishing element hinge has a support foot connected to the fixed hinge part and resting on the support surface to unload at least the weight of the door directly onto the support surface.

7 Claims, 6 Drawing Sheets

(56) References Cited

U.S. PATENT DOCUMENTS

| | | | | |
|---|---|---|---|---|
| 2012/0038259 | A1* | 2/2012 | Lee | F25D 23/028 312/405 |
| 2013/0076222 | A1* | 3/2013 | Lee | F25D 23/028 16/248 |
| 2013/0147336 | A1* | 6/2013 | Lee | E05D 11/00 312/405 |
| 2018/0195791 | A1* | 7/2018 | Wu | F25D 23/021 |

FOREIGN PATENT DOCUMENTS

| | | | | |
|---|---|---|---|---|
| GB | 819500 | A | 9/1959 | |
| JP | H07608 | Y2 * | 1/1995 | E05D 7/04 |
| JP | 3089871 | U * | 11/2002 | F04D 29/30 |
| JP | 2012041688 | A * | 3/2012 | E05D 15/266 |

OTHER PUBLICATIONS

Written Opinion of the International Searching Authority for International Patent Application No. PCT/IB2020/056560, dated Jan. 20, 2021.

* cited by examiner

FURNISHING ELEMENT HINGE AND FURNISHING ELEMENT

CROSS-REFERENCE TO RELATED APPLICATIONS

This application is a National Phase Application of PCT International Application PCT/IB2020/056560, having an International Filing Date of Jul. 13, 2020 which claims priority to Italian Application No. 102019000013620 filed Aug. 1, 2019, each of which is hereby incorporated by reference in its entirety.

FIELD OF THE INVENTION

The present invention relates to a furnishing element hinge, as well as to a furnishing element.

In particular, the present invention relates to a furnishing element hinge adapted to connect at least rotatably a door to a fixed structure of a furnishing element.

BACKGROUND ART

In the field of furnishing elements provided with movable doors, at least rotatably connected to a fixed structure resting on a support surface, a particularly felt need is the balanced adjustment and alignment of each door with respect to another one and/or with respect to the fixed structure.

Usually, the doors are connected to the fixed structure of the furnishing element by a plurality of hinges which connect the door to the fixed structure rotatably or in roto-translation.

The hinges of the known type comprise mechanisms for the adjustment of the relative position between the movable hinge part and the fixed hinge part so as to align the position of the door with respect to another door and/or to the fixed part of the furnishing element.

The alignment of a door to another door and/or to the fixed structure involves, on one hand, a geometric alignment between the doors and/or the geometry of the fixed structure, and, on the other hand, a balanced distribution of the load of the doors with respect to the support surface of the furnishing element.

The doors lose the alignment thereof both due to the natural wear of the hinges and of the position adjustment mechanisms, as well as due to slight geometric variations of the fixed structure of the furnishing element and/or of the support surface on which the furnishing element rests.

The geometric alignment alone is not sufficient to ensure the balanced distribution of the door loads, in fact, if the support surface of the furnishing element is not perfectly flat, it may happen that the doors, although geometrically aligned with the geometry of the fixed structure, do not maintain the opening position or, vice versa, the closing position of the fixed structure defined compartment.

Over time, and as the number of opening and closing cycles of the doors of a furnishing element increases, the alignment of the doors is lost, and a periodic adjustment of the hinges is required.

Furthermore, usually, the hinges of the known type are connected in a plurality of points to the shoulder of the fixed structure, and thus they stress such shoulder by disadvantageously accelerating the variations of the geometric type of the fixed structure, thus making the adjustments of the hinges for aligning the door more frequent.

A correct adjustment of the hinges of the known type is far from simple, since it must ensure not only a geometric alignment between the doors and the fixed structure, but also a distribution of the loads of the doors as balanced as possible with respect to the planarity conditions of the support surface of the furnishing element.

Such adjustment is therefore so complicated that many users are forced to turn to highly expensive specialized furniture assemblers.

In the context of furnishing elements, the need is therefore felt to devise devices for opening and closing doors with respect to the fixed structures which they are connected to, which maintain the alignment of the doors as much as possible over time and which thus reduce the frequency of the adjustments of the alignment and which are easily adjustable by an average user.

Therefore, the problem underlying the present invention is that of devising a furnishing element hinge which has structural and functional features such as to satisfy the aforesaid needs while overcoming the drawbacks mentioned with reference to the prior art.

SUMMARY OF THE INVENTION

The present invention aims to provide a furnishing element hinge which allows an adjustment of the position of a door with respect to the fixed structure to which it is connected and with respect to the support surface on which the furnishing element rests which is, on the one hand, simplified and, on the other, which allows to maintain the correct adjustment of the position of the door in a permanent manner, limiting the number of interventions required to adjust such position over time.

This and other objects and advantages are achieved by a furnishing element hinge and a furnishing element as described and claimed herein.

Some advantageous embodiments are the subject of the dependent claims.

From the discussion of the claimed solution, it emerges that the suggested solution allows to simplify the adjustment of the position of the door by freeing, with a single device, the adjustment of the position of the door with respect to the support surface of the furnishing element from the adjustment of the position of the door with respect to the geometry of the fixed structure.

Furthermore, the suggested solution maintains the geometric alignment between a door and the fixed structure to which it is permanently connected, preventing the door from stressing the fixed structure with the weight thereof and limiting the occurrence of geometric variations in the fixed structure, which would lead to an increase in the frequency of the maintenance of the door position alignment with the geometry of the fixed structure.

The suggested solution allows to easily and intuitively correct planarity defects on the support surface of the furnishing element and provides highly precise and easy-to-use door position adjustment mechanisms.

BRIEF DESCRIPTION OF THE FIGURES

Further features and advantages of the invention will become apparent from the following description of preferred embodiments thereof, given by way of non-limiting example, with reference to the accompanying drawings, in which.

DESCRIPTION OF SOME PREFERRED EMBODIMENTS

Figure 1:
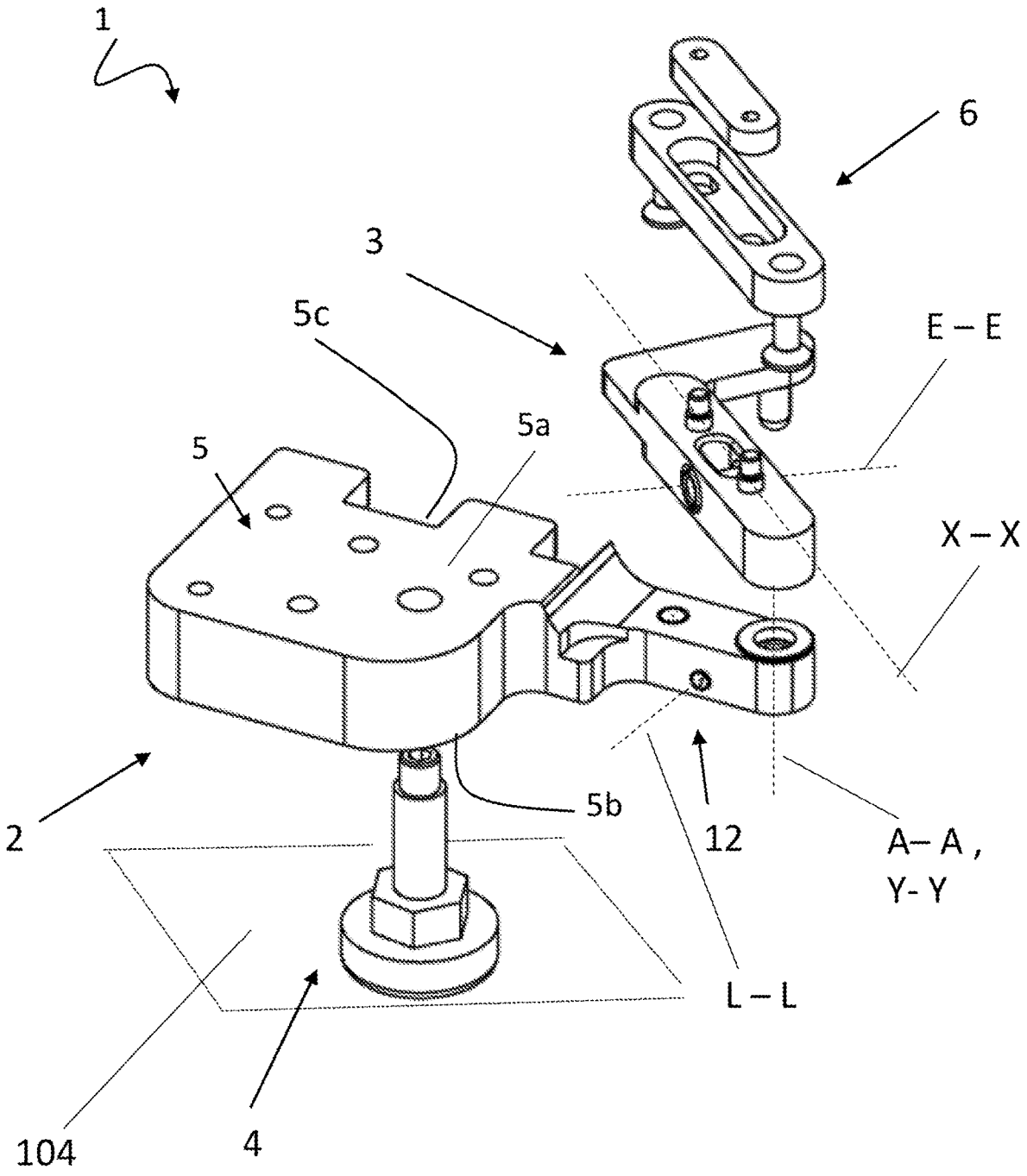
FIG. 1 shows a partially exploded perspective view of a furnishing element hinge in accordance with the invention comprising a fixed hinge part, a movable hinge part, a mechanism for the horizontal adjustment and a mechanism for the vertical adjustment of the position of a door connectable to the movable hinge part with respect to the fixed structure of a furnishing element to which the fixed hinge part may be connected.
Figure 2:
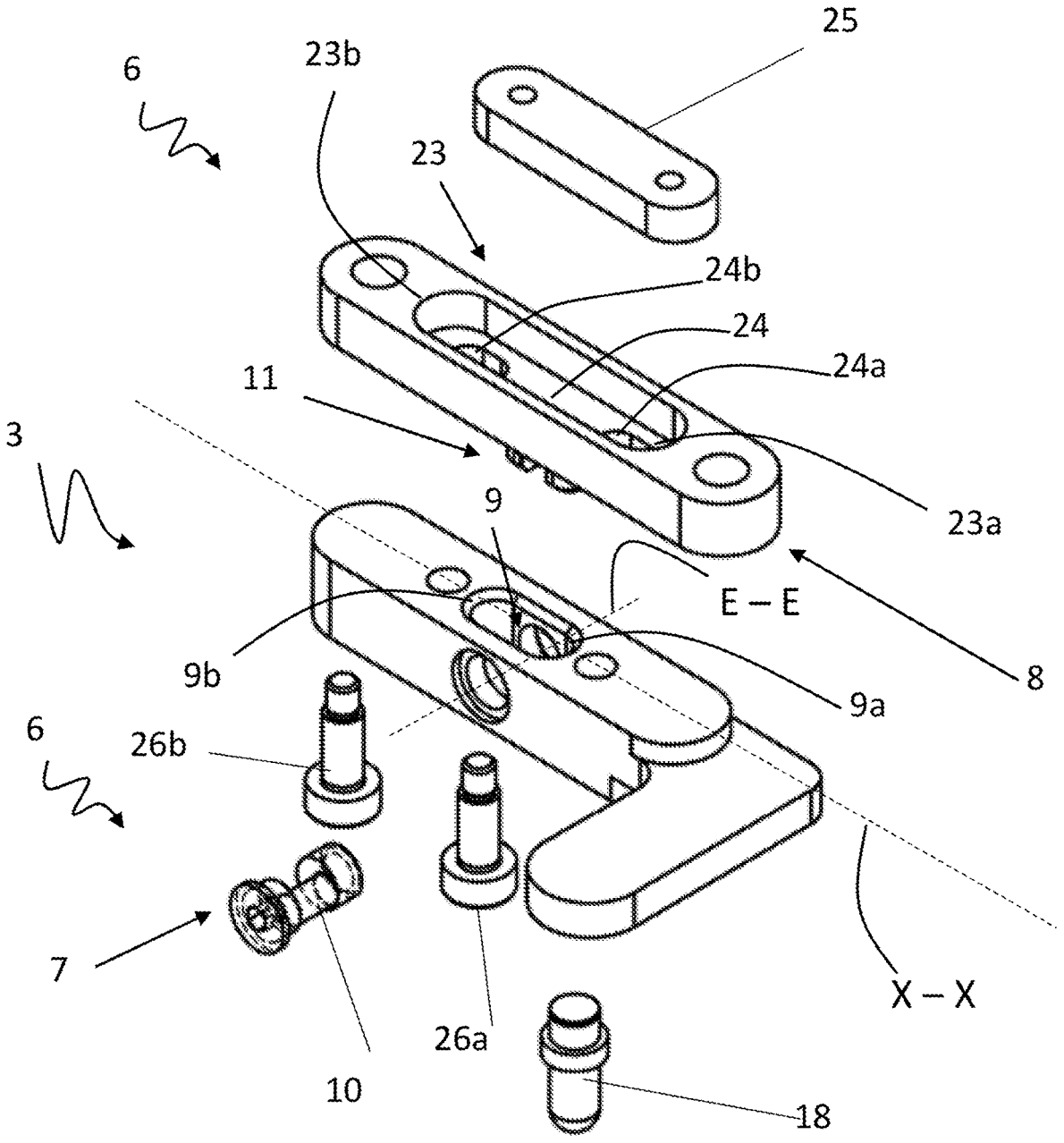
FIG. 2 shows an exploded perspective view of the movable hinge part and the horizontal adjustment mechanism of FIG. 1.
Figure 3A:
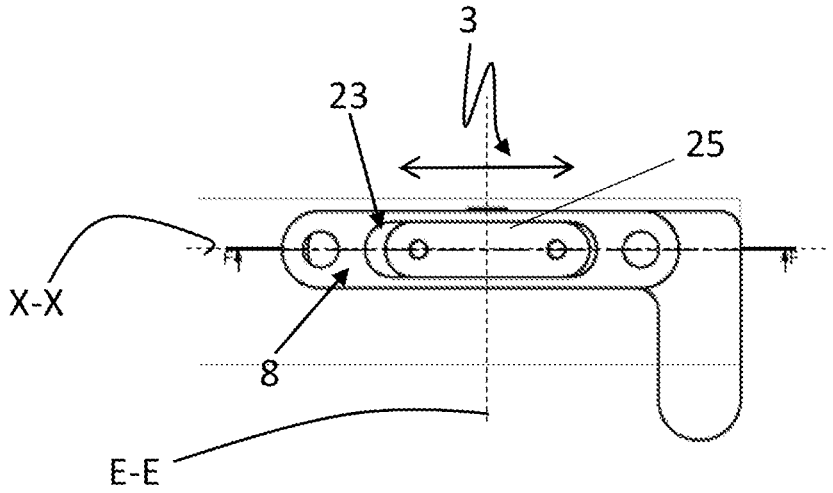
FIGS. 3*a*, 3*b* and 3*c* show a plan view, a diagrammatic side view, and a sectioned view, respectively, of the movable hinge part and the horizontal adjustment mechanism of FIG. 2 assembled.
Figure 3B:
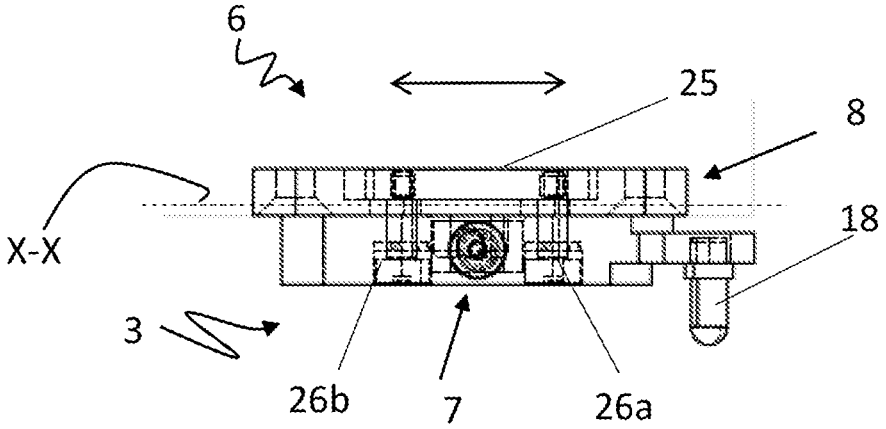
Figure 3C:
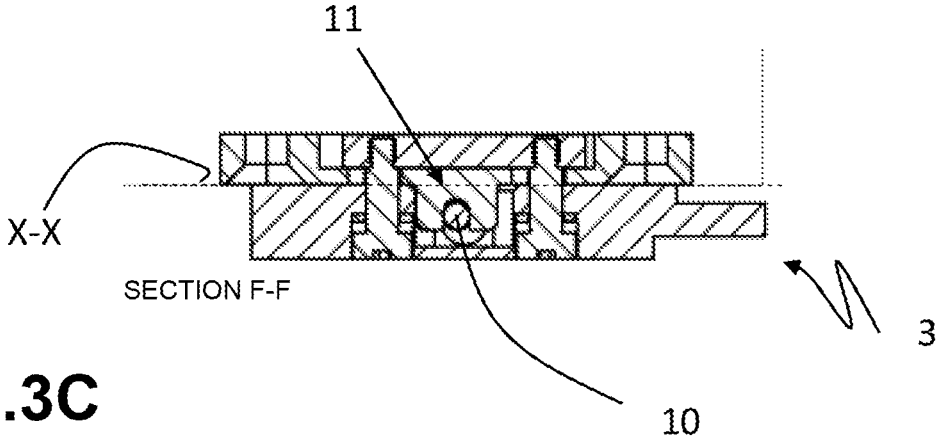
Figure 4:
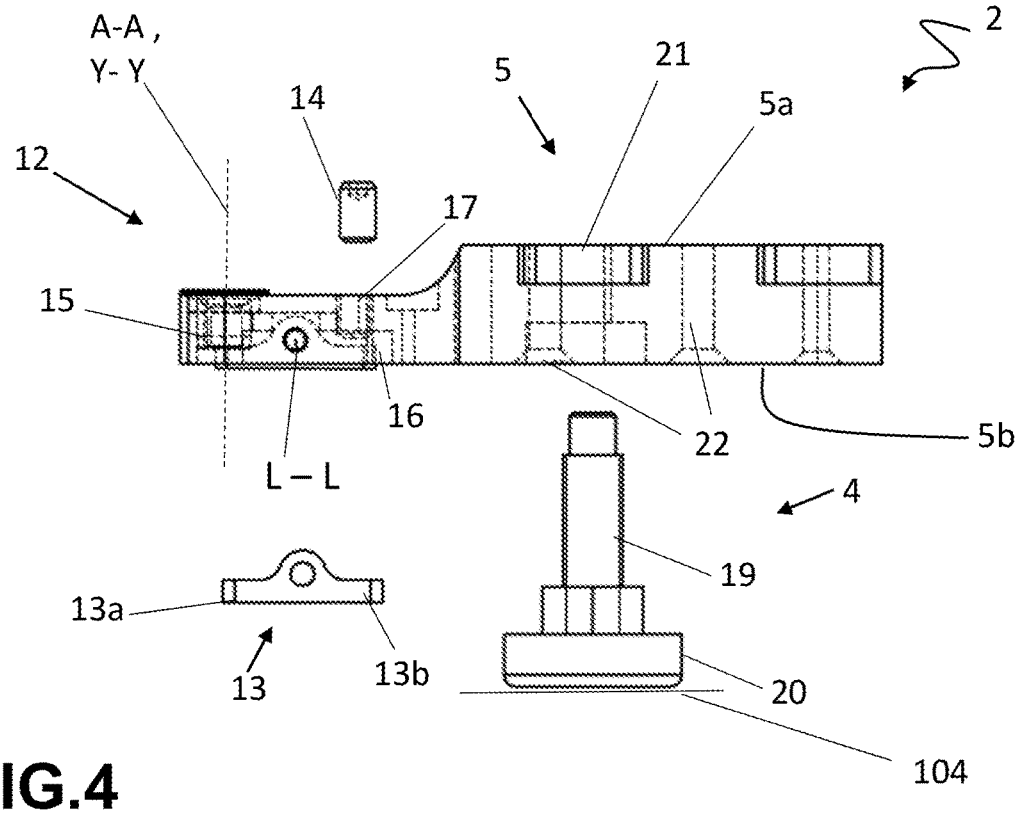
FIG. 4 shows a diagrammatic side view of the fixed hinge part of FIG. 1, in which some elements are exploded, and others are shown with dashed lines to show the internal structure thereof.
Figure 5:
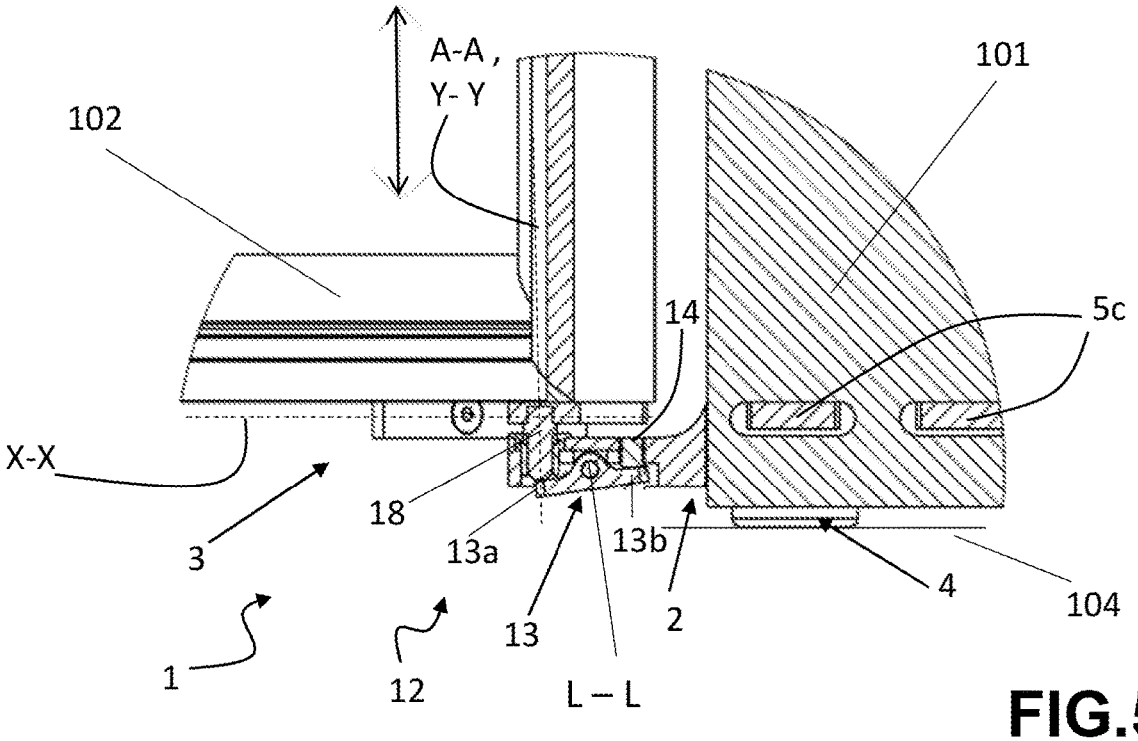
FIG. 5 shows a diagrammatic sectioned view of the hinge according to the invention connected to a door and to a fixed structure of a furnishing element, in which, in particular, the vertical adjustment mechanism is shown.
Figure 6:
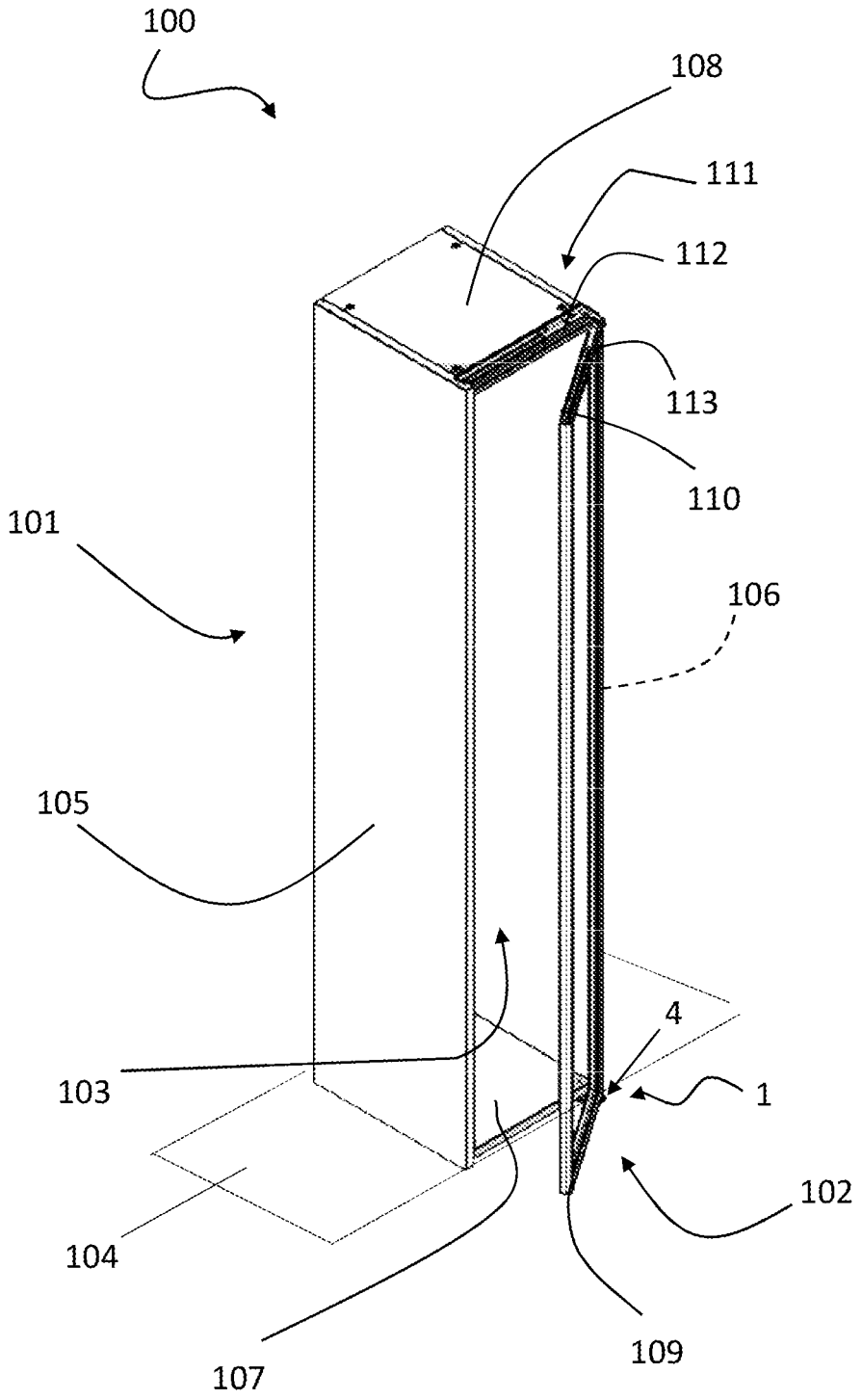
FIG. 6 shows a raised side perspective view of a furnishing element according to the present invention.
Figure 7:
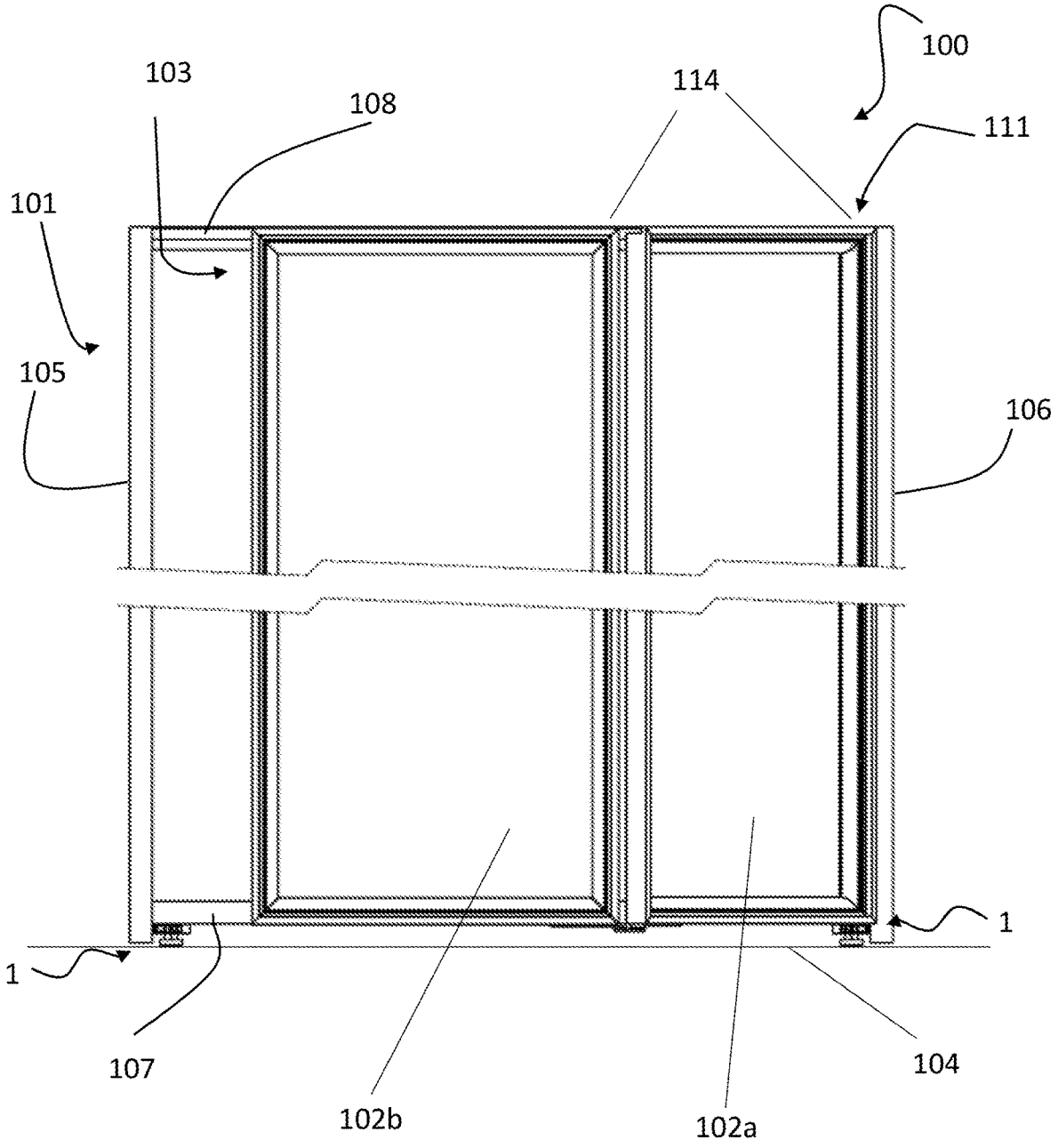
FIG. 7 shows a side view of a furnishing element according to an embodiment of the furnishing element of the invention.

In accordance with a general embodiment, a furnishing element hinge is indicated by reference numeral 1.

Said furnishing element hinge 1 is adapted to movably connect a door 102 to a fixed structure 101 of a furnishing element 100.

Said structure 101 rests on a support surface 104 and delimits a compartment 103.

Said furnishing element hinge 1 comprises a fixed hinge part 2, adapted to be connected to the fixed structure 101.

Said furnishing element hinge 1 further comprises a movable hinge part 3, adapted to be connected to the door 102.

Said movable hinge part 3 is movable at least rotatably with respect to the fixed hinge part 2 at least between a first position, adapted to open said compartment 103 and a second position, adapted to close said compartment 103.

In other words, in said second position of the movable hinge part 3, the door 102, to which the movable hinge part 3 is connectable, is positioned, with respect to the fixed structure 101, closing the compartment 103, while in said first position of the movable hinge part 3, the door 102 is at least rotated with respect to the fixed structure in one of the possible opening positions of said compartment 103.

Said furnishing element hinge 1 comprises a support foot 4.

Said support foot 4 is connected to a fixed hinge part 2.

Said support foot 4 is adapted to rest on said support surface 104 to unload at least the weight of said door 102 directly onto the support surface 104.

In accordance with an embodiment, said fixed hinge part 2 is adapted to unload the weight of the door 102 onto the support foot 4, avoiding unloading the weight of the door 102 onto the fixed structure 101.

Therefore, the furnishing element hinge 1 also acts as a support structure for the door 102 and thereby the weight of the door 102 weighs on the support foot 4 and not on the fixed structure 101, thus avoiding stressing it.

According to an embodiment, said fixed hinge part 2 comprises a hooking portion 5 adapted to be connected to said fixed structure 101.

Said hooking portion 5 has an apical surface 5*a* adapted to be connected to said fixed structure 101.

Said hooking portion 5 has a basal surface 5*b* diametrically opposite with respect to said apical surface 5*a*.

Said basal surface 5*h* is adapted to face said support surface 104.

In accordance with an embodiment, said hooking portion 5 has a shaped lateral surface 5*c* adapted to be housed in an undercut of said fixed structure 101.

In accordance with an embodiment, said hooking portion 5 comprises a plurality of fastening holes 22, passing through a direction transverse between said apical surface 5*a* and said basal surface 5*b*.

Said plurality of fastening holes 22 are adapted to house a respective plurality of fastening elements to the fixed structure 101 of said furnishing element 100.

In accordance with an embodiment, said support foot 4 protrudes from said basal surface in the direction of said support surface 104.

In accordance with an embodiment, said support foot 4 is movable between a minimum extension position and a maximum extension position with respect to said basal surface 5*b*.

According to an embodiment, said support foot 4 is adjustable in a direction transverse with respect to said support surface 104.

In accordance with an embodiment, said support foot 4 is adapted to unload at least one part of the weight of said fixed structure 101 onto said support surface 104.

In accordance with an embodiment, said support foot 4 comprises a stem 19 connected to a flat support base 20 configured to rest on said support surface 104.

In accordance with an embodiment, said stem 19 is connected to said flat support base 20 in a jointed manner.

According to an embodiment, said stem 19 is threaded and connected to said fixed hinge part in a threaded hole 21 obtained in said hooking portion 5.

According to an embodiment, said threaded hole 21 is a hole passing through said hooking portion 5 in a direction transverse to the basal and apical surface.

In accordance with an embodiment, said support foot 4 is movable in rotation in the respective threaded seat between said minimum extension position and said maximum extension position with respect to said basal surface 5*b*.

Therefore, when the furnishing element hinge 1 is connected to the furnishing element 100, the support foot 4 acts, on the one side, as a structure supporting said fixed structure 101 by unloading the weight of a part of it on the support surface 104, and, on the other side, it acts as an element for the adjustment under load of the distance between said fixed structure 101 and said support surface 104.

In accordance with an embodiment, said furnishing element hinge 1 includes at least one mechanism for the horizontal adjustment 6 of the position of said movable hinge part 3 with respect to said fixed hinge part 2.

Said first horizontal adjustment mechanism 6 comprises at least one fixed rotatable element 7 connected to the movable hinge part 3 in a rotatable manner.

Said first horizontal adjustment mechanism 6 further comprises a translational slide 8 connected to said movable hinge part 3 in a translatable manner along a horizontal direction X-X belonging to a plane substantially parallel to said support surface 104.

Said translational slide 8 is connectable in a fixed manner to said door 102.

Said fixed rotatable element 7 is adapted to cooperate with said translational slide 8, so that a rotation of said fixed rotatable element 7 transmits a linear motion to the translational slide 8, thus allowing to carry out a horizontal adjustment of the position of said door 102 with respect to said fixed structure 101.

In accordance with an embodiment, said movable hinge part 3 comprises a hollow eyelet 9 developing along said horizontal direction X from a first hollow eyelet end 9*a* to a second hollow eyelet end 9*b*.

Said fixed rotatable element 7 comprises an eccentric pin 10 and has a rotation axis E-E transverse to said horizontal direction X.

Said fixed rotatable element 7 is rotatably hinged to said movable hinge part 3.

Said rotatable eccentric pin 10 is positioned inside said hollow sliding eyelet 9.

Said translational slide 8 comprises a connection element 11 protruding in a vertical direction with respect to said support surface 104.

Said connection element 11 is housed inside the hollow sliding eyelet 9 and interferes with said eccentric pin 10.

Said first horizontal adjustment mechanism 6 is configured so that a clockwise rotation, or vice versa, of the eccentric pin 10 interfering with said connection element 11 transmits a linear motion along said horizontal direction X-X to the translational slide 8 with respect to said movable hinge part 3, between a first lateral position, in which said connection element 11 is close to said first eyelet end 9*a* and a second lateral position, in which said connection element 11 is close to said second eyelet end 9*b*, or vice versa.

In accordance with an embodiment, said translational slide 8 has a longitudinal slot 23 developing along said horizontal direction X-X between a first slot end 23*a* and a second slot end 23*b*.

Said longitudinal slot 23 has a slot bottom 24 and a first bottom eyelet 24*a* and a second bottom eyelet 24*b*, both passing through said slot bottom 24.

Said furnishing element hinge 1 comprises a slot insert 25 housed in said longitudinal slot 23.

Said slot insert 25 is connected in a fixed manner to said movable hinge part 3 by means of two connection elements, such as, for example, a first screw 26*a* and a second screw 26*b*, respectively passing through said first bottom eyelet 24*a* and said bottom eyelet 24*b*, so as to prevent a detachment between said translational slide 8 and said movable hinge part 3 and, at the same time, to allow a translation of said translational slide 8 in said horizontal direction X-X for a stroke in one direction and in the other one which is less than or equal to the dimension in the horizontal direction of said first bottom eyelet 24*a* and said second bottom eyelet 24*b*. In other words, said translational slide 8 is positioned in interposition between said movable hinge part and said slot insert, which are connected in a fixed manner, and may be translated in a horizontal direction X-X by a stroke less than or equal to the dimension of the bottom slot 24*a* or 24*b* in one direction and the other one.

In accordance with an embodiment, said connection element 11 is obtained in a median position with respect to the centers of said first bottom eyelet 24*a* and said second bottom eyelet 24*b*.

According to an embodiment, said connection element 11 is obtained in the form of a fork which has a recess in which said eccentric pin 10 is positioned. Said eccentric pin 19 rotates inside the recess and interferes with the internal edges of the recess to move said translational slide 8.

In accordance with an embodiment, said hinge 1 includes a mechanism for the vertical adjustment 12 of the position of said movable hinge part 3 with respect to said fixed hinge part 2.

Said vertical adjustment mechanism 12 has a lever 13 rotatably connected to the fixed hinge part 2.

Said vertical adjustment mechanism 12 further has a rotatable adjustment dowel 14 which is connected to said fixed hinge part 2 and is adapted to adjust the inclination of the lever 13.

Said rotatable adjustment dowel 14 is configured to cooperate, by interference, with the lever 13 so that a rotation of the dowel 14 transmits a vertical movement to the movable hinge part 3 along a vertical direction Y-Y substantially perpendicular to said support surface 104 to execute a vertical adjustment of the position of said door 102 with respect to said fixed structure 101.

In accordance with an embodiment, said fixed hinge part 2 comprises a hinge hole 15 defining a hinge rotation axis A-A parallel to said vertical direction Y-Y.

Said fixed hinge part 2 comprises a lever housing 16 in communication with said hinge hole 15.

Said fixed hinge part 2 comprises a dowel seat 17 which develops along a direction parallel to said hinge hole 15 and is in communication with said housing 16.

Said lever 13 is positioned in said lever housing 16 and is pivoted to the fixed hinge part 2 with the lever rotation axis L-L transverse to said vertical direction Y-Y.

Said lever rotation axis L-L is arranged in an intermediate position between the hinge hole 15 and said dowel seat 17.

Said movable hinge part 3 comprises a hinge pin 18 housable in said hinge hole 15.

Said lever 13 has a first lever arm 13*a* configured to interact with the hinge pin 18 housed in the hinge hole 15 and a second lever arm 13*b* configured to interact with the rotatable adjustment dowel 14.

Said rotatable adjustment dowel 14 is positioned in the dowel seat 17 and is rotatably movable in the dowel seat 17 between a minimum extraction position and a maximum extraction position inside the lever housing 16.

The vertical adjustment mechanism 12 is configured so that a rotation of the rotatable adjustment dowel 14, on interference with the second lever arm 13*b*, transmits a rotation of said lever 13, which moves the first lever arm 13*a*, on interference with the hinge pin 18, along the vertical direction Y-Y so as to execute a vertical adjustment of the position of the door 102 with respect to the fixed structure 101.

In accordance with an embodiment, said lever 13 is a rocker arm.

According to an embodiment, said first lever arm 13*a* and said second lever arm 13*b* have the same size.

In accordance with an embodiment, said dowel 14 is threaded and said dowel seat 17 is threaded.

In accordance with an embodiment, said furnishing element hinge 1 is retractable.

The present invention also relates to a furnishing element 100.

Said furnishing element 100 comprises a fixed structure 101 resting on a support surface 104 and at least one door 102.

Said furnishing element 100 comprises at least one furnishing element hinge 1 as previously described which at least rotatably connects the door 102 to said fixed structure 101.

Said hinge 1 comprises a support foot 4 resting on said support surface 104 to unload at least the weight of the door 102 directly onto the support surface 104.

In accordance with an embodiment, the fixed structure 101 comprises at least a first shoulder 105 and a second shoulder 106 connected by a structural base shelf 107 and by a structural head shelf 108.

Said door 102 comprises a door base 109 and a door head 110.

Said at least one furnishing element hinge 1 comprises a fixed hinge part 2 connected to said structural base shelf 107 and a movable hinge part 3 connected to said door base 109.

Said furnishing element 1 comprises at least a second hinge 111 comprising a fixed second hinge part 112 connected to said fixed structure 101 and a movable second hinge part 113 connected to said door 102.

In accordance with an embodiment, said at least one door 102 comprises a first movable door 102*a* constrained to said fixed structure 101 by means of said furnishing element hinge 1 and a second movable door constrained 102*b* to said first movable door 102*a* by means of a hinge constraint.

Said at least a second hinge 111 is a jointed parallelogram mechanism 114 connected to said fixed structure 101 and at least one from said first movable door 102*a* and said second movable door 102*b*.

LIST OF REFERENCE SYMBOLS

1 furnishing element hinge
2 fixed hinge part
3 movable hinge part
4 support foot
5 hooking portion
5*a* apical hooking portion surface
5*b* basal hooking portion surface
5*c* shaped lateral surface of hooking portion
6 first horizontal adjustment mechanism
7 fixed rotatable element
8 translational slide
9 hollow sliding eyelet
9*a* first hollow eyelet end
9*b* second hollow eyelet end
10 eccentric pin
11 connection element
12 vertical adjustment mechanism
13 lever
13*a* first lever arm
13*b* second lever arm
14 rotatable adjustment dowel
15 hinge hole
16 lever housing
17 dowel seat
18 hinge pin
19 stem
20 flat base
21 (threaded) hole
22 plurality of fastening through holes
23 longitudinal slot
23*a* first slot end
23*b* second slot end
24 slot bottom
24*a* first bottom eyelet
24*b* second bottom eyelet
25 slot insert
26*a* first screw
26*b* second screw
100 furnishing element
101 fixed structure
102 door
102*a* first movable door
102*b* second movable door
103 compartment
104 support surface
105 first shoulder
106 second shoulder
107 structural base shelf
108 structural head shelf
109 door base
110 door head
111 second hinge
112 fixed second hinge part
113 movable second hinge part
114 jointed parallelogram mechanism
X-X horizontal direction
Y-Y vertical direction
A-A hinge rotation axis
L-L lever rotation axis
E-E eccentric pin rotation axis

The invention claimed is:

1. A furnishing element hinge for movably connecting a door to a fixed structure of a furnishing element, wherein said fixed structure rests on a support surface and delimits a compartment, said furnishing element hinge comprises a fixed hinge part, adapted to be connected to said fixed structure and a movable hinge part, adapted to be connected to said door, said movable hinge part is movable at least rotatably with respect to said fixed hinge part at least between a first position, adapted to open said compartment and a second position, adapted to close said compartment, said furnishing element hinge further comprises a support foot, said support foot being connected to said fixed hinge part, and wherein said support foot is configured to rest on said support surface to unload at least a weight of said door directly onto said support surface;

the furnishing element hinge further comprising a horizontal adjustment mechanism for horizontally adjusting a position of said movable hinge part connectable to said door with respect to said fixed hinge part connectable to said fixed structure, wherein said horizontal adjustment mechanism comprises a fixed rotatable element connected to said movable hinge part, or to said fixed hinge part, and a translational slide connected to said movable hinge part, or to said fixed hinge part, in a translatable manner, along a horizontal direction (X-X) belonging to a plane, parallel to said support surface and connectable, in a fixed manner, to said door, or to said movable hinge part, and wherein said fixed rotatable element is adapted to cooperate with said translational slide so that a rotation of said fixed rotatable element transmits a linear motion to said translational slide to execute a horizontal adjustment of the position of said door with respect to said fixed structure along said horizontal direction (X-X);

wherein said movable hinge part comprises a hollow sliding eyelet developing along said horizontal direction (X-X) from a first hollow eyelet end to a second hollow eyelet end, wherein said fixed rotatable element comprises an eccentric pin having an eccentric pin rotation axis (E-E) transverse to said horizontal direction (X-X), wherein said fixed rotatable element is rotatably hinged to said moveable hinge part, with said eccentric pin positioned inside said hollow sliding eyelet, wherein said translational slide comprises a connection element protruding in a vertical direction (Y-Y) with respect to said support surface, said connection element being housed in said hollow sliding eyelet and interfering with said eccentric pin, and wherein said horizontal adjustment mechanism is configured so that a clockwise rotation, or vice versa, of said eccentric pin interfering with said connection element transmits the linear motion to said translational slide with respect to said movable hinge part, between a first lateral position, in which said connection element is close to said first eyelet end and a second lateral position, in which said connection element is close to said second eyelet end, or vice versa.

2. The furnishing element hinge of claim 1, wherein said fixed hinge part is configured to unload the weight of said door onto said support foot, so as to unload the weight of said door directly on said support surface, preventing the weight of said door from being unloaded onto said fixed structure.

3. The furnishing element hinge of claim 1, wherein said fixed hinge part comprises a hook portion having an apical surface, configured to be connected to said fixed structure and a basal surface, configured to face said support surface;

said support foot protrudes from said basal surface; and wherein said support foot is movable between a minimum extension position and a maximum extension position with respect to said basal surface.

4. The furnishing element hinge of claim 1, further comprising a vertical adjustment mechanism for vertically adjusting the position of said movable hinge part with respect to said fixed hinge part, said vertical adjustment mechanism having a lever rotatably connected to said fixed hinge part and a rotatable adjustment dowel for adjusting an inclination of said lever connected to said fixed hinge part, wherein said rotatable adjustment dowel is configured to cooperate, by interference, with said lever so that a rotation of said rotatable adjustment dowel transmits a vertical movement to said movable hinge part along a vertical direction (Y-Y) perpendicular to said support surface to execute a vertical adjustment of the position of said door with respect to said fixed structure.

5. The furnishing element hinge of claim 4, wherein said fixed hinge part comprises a hinge hole defining a hinge rotation axis (A-A) parallel to said vertical direction (Y-Y), a lever housing in communication with said hinge hole and a dowel seat in communication with said lever housing, wherein said dowel seat develops along a parallel direction to said hinge hole, said lever is positioned in said lever housing and pivoted to said fixed hinge part with a lever rotation axis (L-L) transverse to said vertical direction (Y-Y) and arranged in an intermediate position between said hinge hole and said dowel seat, said movable hinge part comprises a hinge pin housed in said hinge hole, said lever comprises a first lever arm configured to interact with said hinge pin housed in said hinge hole and a second lever arm configured to interact with said rotatable adjustment dowel, said rotatable adjustment dowel being positioned in said dowel seat and being rotatably movable in said dowel seat between a minimum extraction position and a maximum extraction position inside said lever housing, and wherein said vertical adjustment mechanism is configured so that, a rotation of said rotatable adjustment dowel, on interference with said second lever arm, transmits a rotation of said lever, which moves said first lever arm, on interference with said hinge pin, along said vertical direction (Y-Y) to execute the vertical adjustment of the position of said door with respect to said fixed structure.

6. The furnishing element hinge of claim 1, wherein said support foot is adjustable in a vertical direction (Y-Y) transverse to said support surface.

7. The furnishing element hinge of claim 1, wherein said support foot is configured to unload at least a part of the weight of said fixed structure onto said support surface.

* * * * *